US009362638B2

(12) United States Patent
Ljubijankic et al.

(10) Patent No.: US 9,362,638 B2
(45) Date of Patent: Jun. 7, 2016

(54) OVERMOLDED CONTACT WAFER AND CONNECTOR

(71) Applicant: AMPHENOL CORPORATION, Wallingford, CT (US)

(72) Inventors: Zlatan Ljubijankic, Mississauga (CA); Barbara H. Marten, Toronto (CA); Karen A. Gibson, Toronto (CA); Andrew B. Matus, Ajax (CA)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 14/475,983

(22) Filed: Sep. 3, 2014

(65) Prior Publication Data

US 2016/0064842 A1 Mar. 3, 2016

(51) Int. Cl.
*H01R 12/71* (2011.01)
*H01R 43/24* (2006.01)
*H01R 43/16* (2006.01)

(52) U.S. Cl.
CPC ..... *H01R 12/716* (2013.01); *H01R 43/16* (2013.01); *H01R 43/24* (2013.01)

(58) Field of Classification Search
CPC ..... H01R 13/514; H01R 12/716
USPC ..... 439/714, 717, 715, 712, 718
See application file for complete search history.

(56) References Cited

U.S. PATENT DOCUMENTS 3,548,367 A * 12/1970 Bruetsch ..... H01R 31/02 439/724
3,605,068 A * 9/1971 Rayburn ..... H01R 13/28 439/133
3,854,790 A * 12/1974 Provinsky ..... H01R 13/514 439/460
4,033,658 A * 7/1977 Asick ..... H01R 27/00 439/218
4,602,831 A * 7/1986 Lockard ..... H01R 24/22 29/858
4,641,426 A * 2/1987 Hartman ..... H01R 9/091 228/180.1
4,655,515 A * 4/1987 Hamsher, Jr. ..... H01R 23/662 29/858
4,865,562 A * 9/1989 Burg ..... H01R 4/2433 439/395
4,973,264 A * 11/1990 Kamono ..... H01R 12/777 29/879
5,171,161 A * 12/1992 Kachlic ..... H01R 13/6275 439/352
5,190,472 A * 3/1993 Voltz ..... H01R 13/65807 439/579
5,194,020 A * 3/1993 Voltz ..... H01R 13/514 439/540.1
5,288,251 A * 2/1994 Sumida ..... H01R 13/514 439/701
5,320,555 A * 6/1994 Okabe ..... H01R 13/6272 439/354

(Continued)

*Primary Examiner* — Ross Gushi
(74) *Attorney, Agent, or Firm* — Blank Rome LLP

(57) ABSTRACT

A contact wafer that has a plurality of contacts. Each of the contacts has a body portion with a mating end and an opposite tail end. The mating end is configured to couple to a mating contact and the tail end is configured to engage a printed circuit board. An overmold surrounds the body portions of the contacts such that the mating ends and the tails ends of the contacts are exposed and extend from opposite ends of said overmold. The overmold has a first side that includes a plurality of recessed surfaces. Each recessed surface is between adjacent body portions of the contacts and sized to receive a corresponding portion of an overmold of another contact wafer.

26 Claims, 6 Drawing Sheets

(56) References Cited

U.S. PATENT DOCUMENTS 5,385,490 A * 1/1995 Demeter ..... H01R 9/038 439/289
5,435,757 A * 7/1995 Fedder ..... H01R 13/40 439/686
5,499,927 A 3/1996 Ohno et al.
5,580,283 A * 12/1996 O'Sullivan ..... H01R 23/6873 439/607.01
5,667,411 A * 9/1997 O'Sullivan ..... H01R 13/41 439/701
5,716,237 A * 2/1998 Conorich ..... H01R 13/6464 439/660
5,722,861 A * 3/1998 Wetter ..... H01R 13/514 29/884
5,775,954 A * 7/1998 Kerckhof ..... H01R 13/514 439/701
5,816,829 A * 10/1998 Chiang ..... H01R 13/405 439/76.1
5,957,719 A * 9/1999 Okabe ..... H01R 4/2466 439/404
5,967,841 A 10/1999 Bianca et al.
6,007,386 A * 12/1999 Okabe ..... H01R 13/42 439/701
6,042,423 A * 3/2000 Murr ..... H01R 12/7005 439/590
6,093,061 A * 7/2000 Varsik ..... H01R 13/506 439/632
6,106,326 A * 8/2000 Schramme ..... H01R 13/504 439/460
6,176,745 B1 * 1/2001 Furutani ..... H01R 13/506 439/701
6,200,171 B1 3/2001 Fusselman et al.
6,231,398 B1 * 5/2001 Furutani ..... H01R 13/506 439/701
6,290,548 B1 * 9/2001 Yeh ..... H01R 13/514 439/607.02
6,343,960 B1 * 2/2002 Sato ..... H01R 13/514 439/660
6,354,887 B2 * 3/2002 Maeda ..... H01R 13/514 439/701
6,386,925 B1 * 5/2002 Sato ..... H01R 13/41 439/701
6,406,335 B2 * 6/2002 Sato ..... H01R 13/514 439/701
6,461,201 B1 * 10/2002 Maeda ..... H01R 13/514 439/680
6,517,389 B2 * 2/2003 Sato ..... H01R 13/514 439/701
6,592,381 B2 * 7/2003 Cohen ..... H01R 12/716 439/65
6,592,410 B2 * 7/2003 Yoshida ..... H01R 13/506 439/507
6,712,626 B2 * 3/2004 Harper, Jr. ..... H01R 13/514 439/590
6,814,620 B1 * 11/2004 Wu ..... H01R 13/514 439/225
6,823,587 B2 * 11/2004 Reed ..... H01R 9/05 29/854
6,837,748 B2 1/2005 Aldridge
6,857,899 B2 * 2/2005 Reed ..... H01R 23/662 439/497
6,881,100 B2 * 4/2005 Barry ..... H01R 12/716 439/701
6,955,565 B2 * 10/2005 Lloyd ..... H01R 9/032 439/607.01
6,981,883 B2 * 1/2006 Raistrick ..... H01R 13/26 439/74
7,104,808 B2 * 9/2006 Korsunsky ..... H01R 9/096 439/607.05
7,108,567 B1 * 9/2006 Korsunsky ..... H01R 12/7082 439/701
7,175,479 B1 * 2/2007 McAlonis ..... H01R 13/6275 29/750
7,229,319 B2 * 6/2007 Dahms ..... H01R 12/716 439/108
7,354,318 B2 * 4/2008 Murakami ..... H01R 4/185 439/701
7,390,200 B2 * 6/2008 Shuey ..... H01R 23/6873 439/79
7,396,259 B2 * 7/2008 Marshall ..... H01R 13/516 439/108
7,407,387 B2 * 8/2008 Johnescu ..... H01R 13/506 439/70
7,410,392 B2 * 8/2008 Szczesny ..... H01R 12/585 439/108
7,422,490 B2 * 9/2008 Droesbeke ..... H01R 13/514 439/701
7,431,616 B2 * 10/2008 Minich ..... H01R 13/514 439/607.05
7,467,955 B2 * 12/2008 Raistrick ..... H01R 13/26 439/75
7,481,682 B2 * 1/2009 Murakami ..... H01R 4/185 439/701
7,572,154 B2 * 8/2009 Ichio ..... H01R 13/4361 361/735
7,572,156 B2 * 8/2009 Schroll ..... H01R 13/514 439/717
7,594,830 B2 * 9/2009 Murakami ..... H01R 4/185 439/701
7,713,096 B2 * 5/2010 Pavlovic ..... H01R 13/514 439/701
7,744,380 B2 6/2010 Shuey et al.
7,744,416 B2 * 6/2010 Zhang ..... H01R 12/716 439/607.11
7,837,514 B2 * 11/2010 Fogg ..... H01R 13/514 439/701
7,862,387 B2 * 1/2011 Weber ..... H01R 12/52 439/686
7,927,144 B2 * 4/2011 Feldman ..... H01R 13/514 439/607.05
7,967,638 B1 * 6/2011 Kline ..... H01R 12/7082 439/607.07
7,976,345 B2 * 7/2011 Szczesny ..... H01R 13/518 439/637
7,997,933 B2 * 8/2011 Feldman ..... H01R 23/688 439/108
8,038,465 B2 * 10/2011 Pavlovic ..... H01R 13/514 361/719
8,083,554 B2 * 12/2011 McAlonis ..... H01R 12/585 439/733.1
8,147,254 B2 * 4/2012 Shuey ..... H01R 13/629 439/74
8,147,268 B2 * 4/2012 Shuey ..... H01R 23/27 439/289
8,210,876 B2 * 7/2012 Derks ..... H01R 13/514 439/607.06
8,491,313 B2 * 7/2013 McNamara ..... H01R 13/6461 439/59
8,550,855 B2 * 10/2013 Zhang ..... H01R 13/405 439/636
8,636,543 B2 * 1/2014 McNamara ..... H01R 13/6461 439/607.07
8,657,627 B2 * 2/2014 McNamara ..... H01R 13/6461 439/108
8,662,942 B2 3/2014 Li
8,684,772 B2 * 4/2014 Yu ..... H01R 13/514 439/717
8,747,168 B2 * 6/2014 Kida ..... H01R 13/506 439/701
8,784,122 B2 * 7/2014 Soubh ..... H01R 12/724 439/79
8,801,464 B2 * 8/2014 McNamara ..... H01R 13/6461 439/607.07
8,915,758 B2 * 12/2014 Shishikura ..... H01R 13/506 439/701
8,936,474 B2 * 1/2015 Katsuse ..... H01R 9/223 439/701
2002/0002016 A1 * 1/2002 Sato ..... H01R 13/514 439/701
2002/0025731 A1 * 2/2002 Sato ..... H01R 13/514 439/701
2002/0123272 A1 * 9/2002 Yoshida ..... H01R 13/506 439/701

(56) References Cited

U.S. PATENT DOCUMENTS

2003/0236032 A1* 12/2003 Sakatani ..... H01R 13/64 439/677
2004/0077228 A1* 4/2004 Wu ..... H01R 13/514 439/701
2004/0235321 A1* 11/2004 Mizumura ..... H01R 13/65807 439/92
2004/0259420 A1* 12/2004 Wu ..... H01R 9/0515 439/607.05
2004/0266273 A1* 12/2004 Wu ..... H01R 13/514 439/701
2005/0196987 A1* 9/2005 Shuey ..... H01R 13/6477 439/108
2007/0141872 A1* 6/2007 Szczesny ..... H01R 12/585 439/108
2009/0011645 A1* 1/2009 Laurx ..... H01R 13/6471 439/607.05
2010/0311278 A1 12/2010 McAlonis et al.
2012/0202363 A1* 8/2012 McNamara ..... H01R 13/6461 439/74
2012/0202386 A1* 8/2012 McNamara ..... H01R 13/6461 439/629
2012/0202387 A1* 8/2012 McNamara ..... H01R 13/6461 439/629
2012/0225576 A1* 9/2012 Kida ..... H01R 13/506 439/345
2013/0122755 A1* 5/2013 Smith ..... H01R 13/514 439/701
2013/0237068 A1* 9/2013 Katsuse ..... H01R 9/223 439/76.2

* cited by examiner

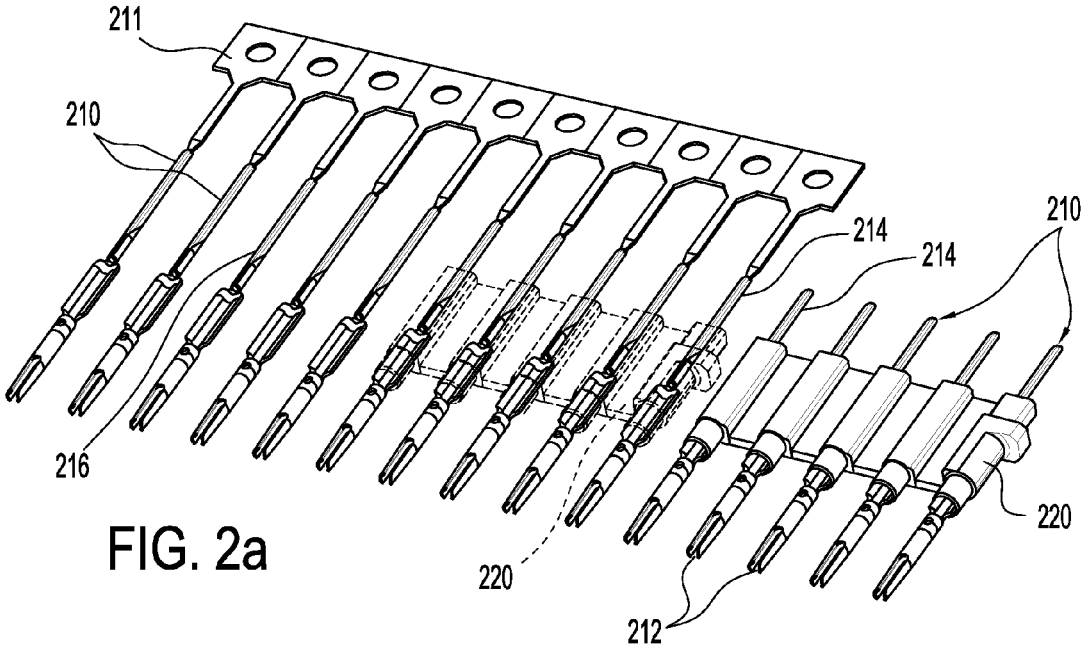
FIG. 2a
FIG. 2b
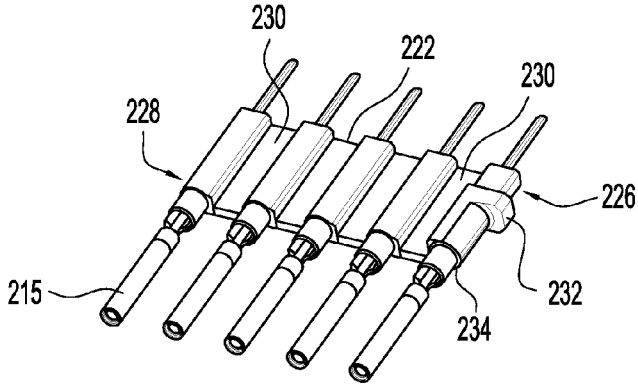
FIG. 2c

OVERMOLDED CONTACT WAFER AND CONNECTOR

FIELD OF THE INVENTION

The present invention relates to an overmolded contact wafer and an electrical connector including the same.

BACKGROUND OF THE INVENTION

Electrical connectors used in the aeronautics industry are required to meet the standards set by Airlines Electronic Engineering Committee, such as ARINC 600. Conventional ARINC connectors typically have a body with two parts including a front insert and a rear insert with corresponding passageways in each for receiving contacts. Multiple steps are required to assemble the conventional ARINC connector including machining individual contacts, installing retaining clips in the passageways of the front insert, bonding the front and rear inserts, and finally installing the contacts into the passageways such that the retaining clips retain the contacts in the passageways. Thus, the conventional ARINC connectors require a number of parts that must be individually assembled together. The conventional ARINC connectors are also bulky and heavy.

Therefore, a need exists for a simplified connector that can be easily made and assembled, is lighter in weight, and meets the ARINC standard.

SUMMARY OF THE INVENTION

Accordingly, the present invention provides a contact wafer that has a plurality of contacts. Each of the contacts has a body portion with a mating end and an opposite tail end. The mating end is configured to couple to a mating contact and the tail end is configured to engage a printed circuit board. An overmold surrounds the body portions of the contacts such that the mating ends and the tails ends of the contacts are exposed and extend from opposite ends of said overmold. The overmold has a first side that includes a plurality of recessed surfaces. Each recessed surface is between adjacent body portions of the contacts and sized to receive a corresponding portion of an overmold of another contact wafer.

The present invention also provides a connector that includes a housing that has a mating interface side and a printed circuit board engagement side opposite the mating interface side, and at least one cavity extending between the mating interface and printed circuit board engagement sides. At least one contact is received in the at least one cavity. The contact includes a body portion with a mating end for coupling to a mating contact and a tail end opposite the mating end for engaging a printed circuit board. An overmold covers the body portion of the contact such that the mating and tail ends extend from opposite sides of the overmold and the mating end is exposed at the mating interface side of the housing and the tail end is exposed at the printed circuit board engagement side of the housing.

The present invention may also provide a connector that includes a housing that has a mating interface side and a printed circuit board engagement side opposite the mating interface side. A plurality of cavities extend between the mating interface and printed circuit board engagement sides. A wafer assembly is coupled to the housing. The wafer assembly includes first and second contact wafers. Each of the first and second contact wafers includes a plurality of contacts adapted to be received in the cavities of the housing. Each of the contacts has a body portion with a mating end and an opposite tail end. The mating end is configured to couple to a mating contact and the tail end is configured to engage a printed circuit board. An overmold surrounds the body portions of the plurality of contacts such that the mating ends and the tails ends of the contacts extend from opposite ends of the overmold and the mating ends are exposed at the mating interface side of the housing and the tail ends are exposed at the printed circuit board engagement side of the housing. The first and second contact wafers are interlocked with one another such that the contacts of the first contact wafer alternate with the contacts of the second contact wafer.

The present invention may further provide a method of manufacturing of a connector that includes the steps of forming a first contact wafer by providing a first group of contacts, each contact including a body portion, a mating end, and a tail end, and applying an overmold to the body portions; forming a second contact water by providing a second group of contacts, each contact including a body portion, a mating end, and a tail end, and applying an overmold to the body portions of the of contacts; interlocking the first and second contacts to form a wafer assembly such that the mating ends of the first and second contact wafers are aligned and the tail ends of the first and second contact wafers align; and installing the wafer assembly into a printed circuit board engagement side of a connector housing such that the mating ends of the first and second contact wafers are exposed at a mating interface side of the connector housing.

With those and other objects, advantages, and features of the invention that may become hereinafter apparent, the nature of the invention may be more clearly understood by reference to the following detailed description of the invention, the appended claims, and the several drawings attached herein.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2*a* is a perspective view of a plurality of contacts of an exemplary embodiment of the present invention, showing a group of the contacts being overmolded to form a wafer;

FIG. 2*b* is a perspective view of a wafer resulting from the overmolding illustrated in FIG. 2*a;*

FIG. 2*c* is a perspective view of the wafer illustrated in FIG. 2*b*, showing the wafer with mating hoods;

DETAILED DESCRIPTION OF THE PREFERRED EMBODIMENTS

Referring to FIGS. 1, 2*a*-2*c*, 3*a*, 3*b*, and 4-7, the present invention relates to an electrical connector 100 and a wafer assembly 120 therefor. The connector 100 preferably meets the ARINC 600 standard that has fewer components and is lighter in weight than conventional ARINC connectors. In a preferred embodiment, the connector 100 has a weight reduction from convention connectors that is about 20 to 25% of the total connector weight. The connector 100 preferably receives a plurality of wafer assemblies 120 which provide the connector with a high density of contacts 210. The contacts 210 are adapted to couple with a mating connector at one end and a printed circuit board at the other end, thereby electrically connecting the mating connector to the circuit board.

Figure 1:
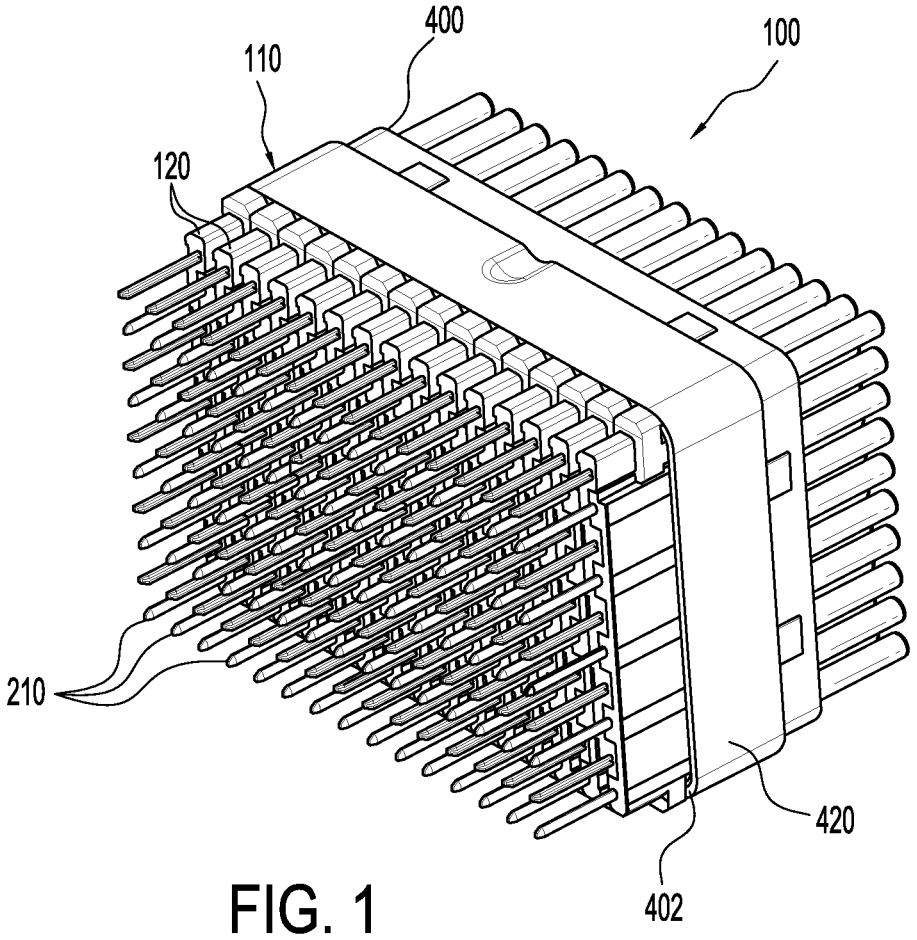
FIG. 1 is a perspective view of a connector according to an exemplary embodiment of the present invention, showing the connector populated with overmolded contact wafer assemblies.
Figure 4:
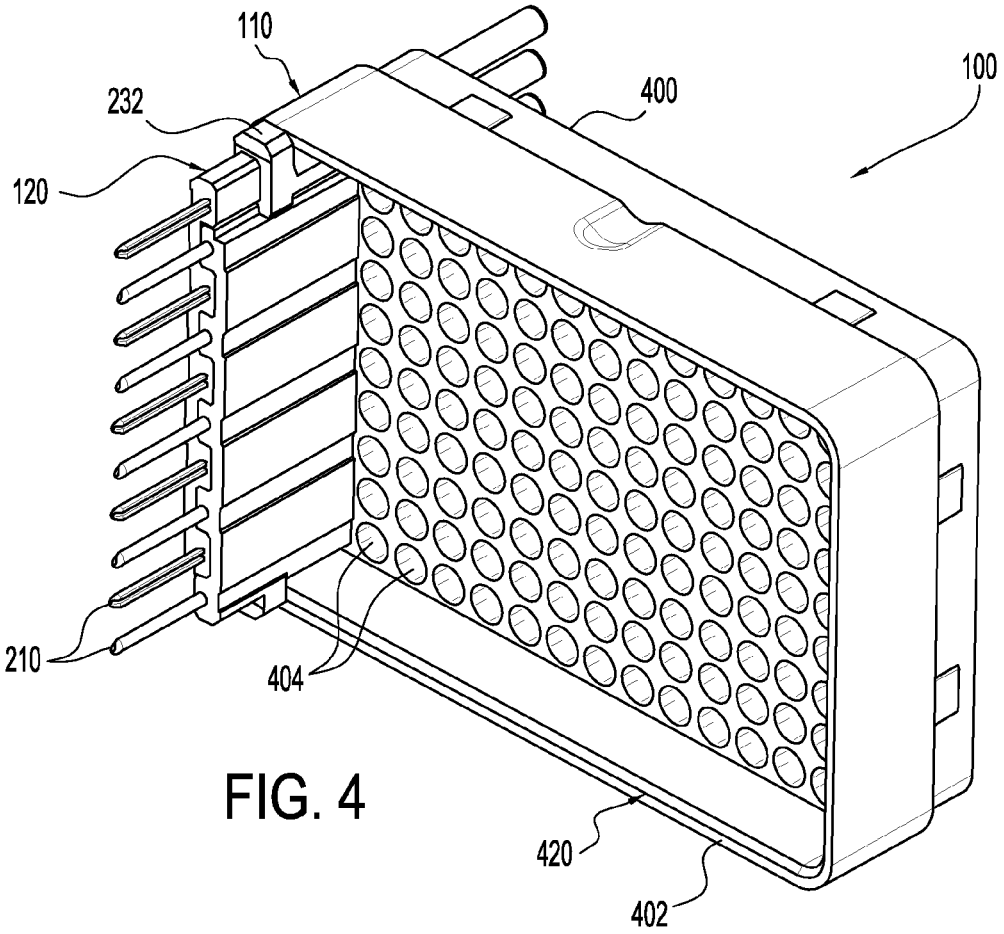
FIG. 4 is a rear perspective view of the connector illustrated in FIG. 1, showing one wafer assembly received in the connector.
Figure 5:
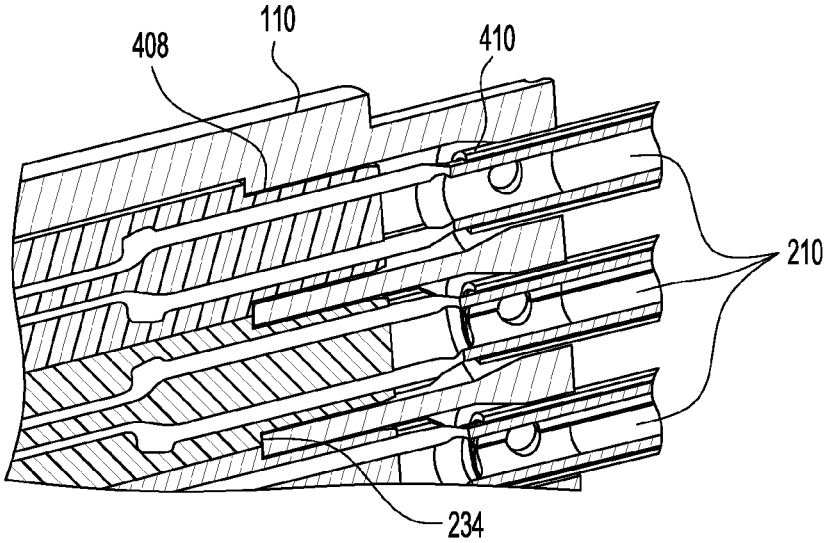
FIG. 5 is an enlarged partial sectional view of the connector illustrated in FIG. 4, through line 5-5.

As seen in FIGS. 1 and 4, the connector 100 generally includes a housing 110 that holds a plurality of wafer assemblies 120 having ends exposed on either side of the housing 110. The housing 110 is preferably a unitary one-piece member. The housing 110 includes one side 400 that interfaces with the mating connector and another side 402 opposite thereof that faces the printed circuit board. A plurality of cavities 404 extend between the sides 400 and 402. The cavities 404 are preferably arranged in a number of columns and rows. Each cavity 404 has an installation end 408 and a contact end 410, as best seen in FIG. 5. The installation ends 408 of the cavities define the face of the printed circuit board side 402 of the housing 110 and the contact ends 410 define the face of the interface side 400 of the housing 110. An overhang 420 may be provided around the perimeter of the printed circuit board side 402 such that the face thereof is recessed, as seen in FIG. 4. The overhang 420 covers a portion of the wafer assemblies 120.

Figure 3A:
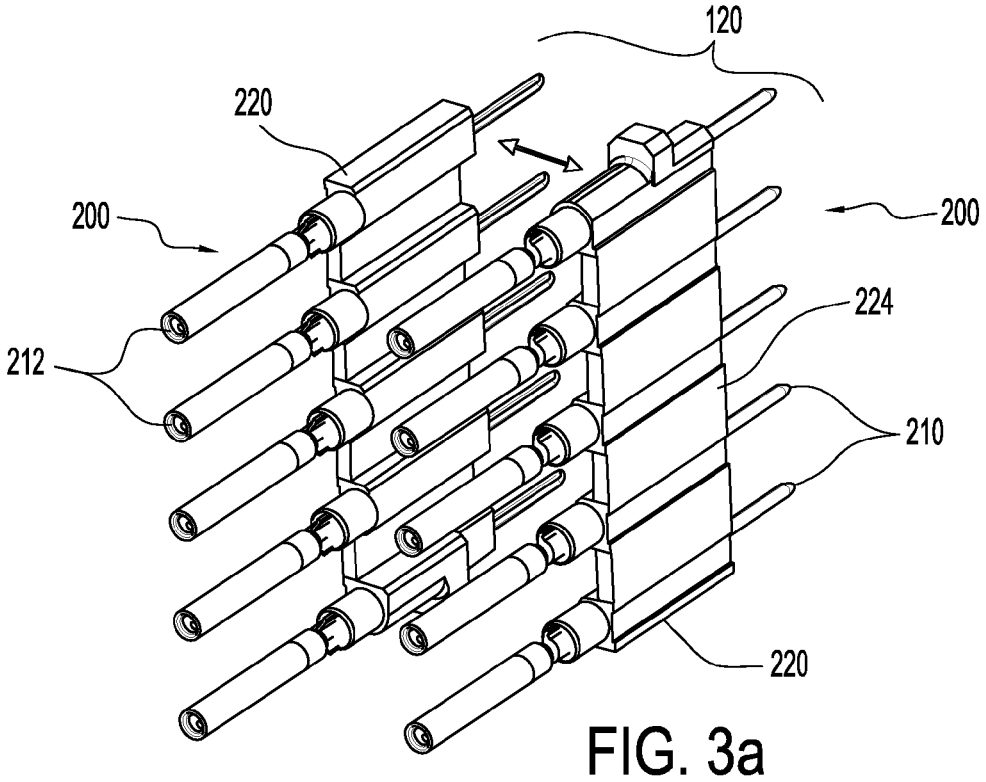
FIG. 3*a* is a perspective view of two of the wafers illustrated in FIG. 2*c*, showing the wafers being interlocked.
Figure 3B:
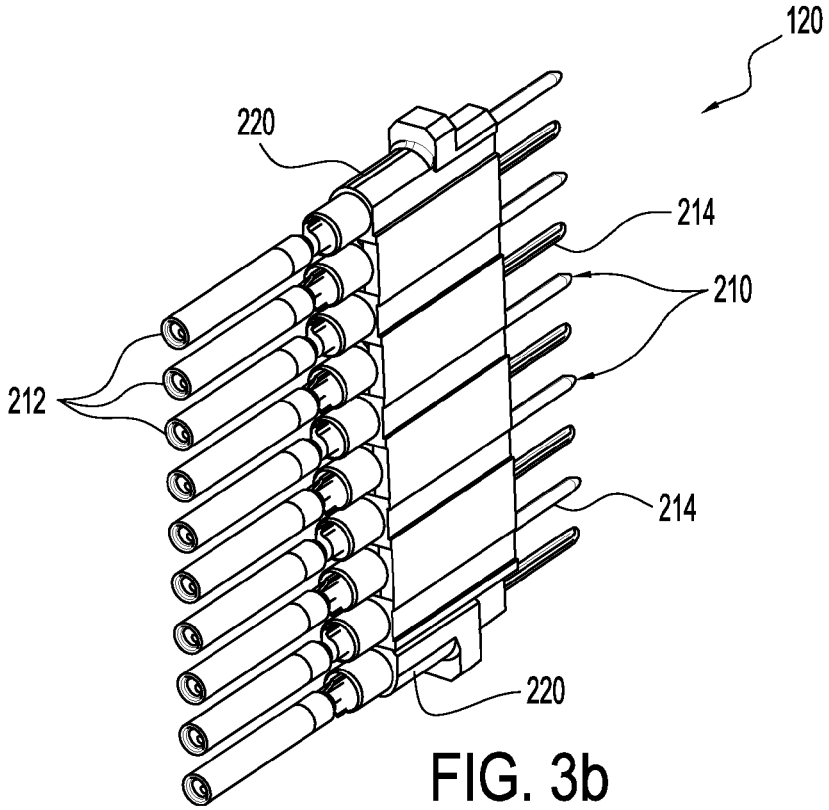
FIG. 3*b* is a perspective view of a wafer assembly formed by the interlocking of the two wafers illustrated in FIG. 3*a;*

Each wafer assembly 120 is formed by interlocking two wafers 200, as illustrated in FIGS. 3*a* and 3*b*. Each wafer 200 includes a plurality of contacts 210 held together by an overmold 220. Each contact 210 includes a mating end 212 and an opposite tail end 214. The ends 212 and 214 of each contact 210 are exposed at either side of the overmold 220. The mating ends 212 of the contacts 210 may include flexible tabs (FIG. 2*b*) that are adapted to engage a mating contact and the tail ends 214 are adapted to engage the printed circuit board, such as by soldering or press fit. To make the wafer 200, a group of the contacts 210 are overmolded to create the overmold 220 over the contacts, as seen in FIG. 2*a*. The carrier strip 211 is then removed at the ends 212 of the contacts 210, as seen in FIG. 2*b*. Mating hoods 215 can then be added to the mating ends 212 of the contacts 210, as seen in FIG. 2*c*.

The overmold 220 is preferably a unitary one-piece member that includes opposite sides 222 and 224 and opposite ends 226 and 228. The first side 222 includes recessed surfaces 230 between the contacts, specifically between adjacent body portions 216 of the contacts. Each recessed surface 230 is designed to receive a corresponding portion of another overmold of another contact wafer, as seen in FIG. 3*a*. The opposite second side 224 (FIG. 3*a*) of the overmold 220 is substantially flat. The overmold 220 may include a stopping tab 232 extending from one of its ends 226 or 228 in a direction substantially perpendicular to the recessed surfaces 230, as seen in FIG. 2*c*. The stopping tab 232 is adapted to stop against the housing 110 when installing the wafer assemblies 120 therein. The overmold 220 may also include a stopping shoulder 234 near the mating end 212 of each contact that engages the installation ends 408 of the housing cavities 404, as best seen in FIG. 5.

As seen in FIG. 3*b*, once the two wafers 200 are interlocked, the contacts 210 of the two wafers 200 alternate and are in alignment. That is, the mating ends 212 of the contacts of both wafers will be aligned and likewise the tail ends 214 of the contacts of both wafers will be aligned. In a preferred embodiment, each wafer assembly 120 has a row of 10 contacts with a pitch of 0.100 inches between contacts.

Figure 6:
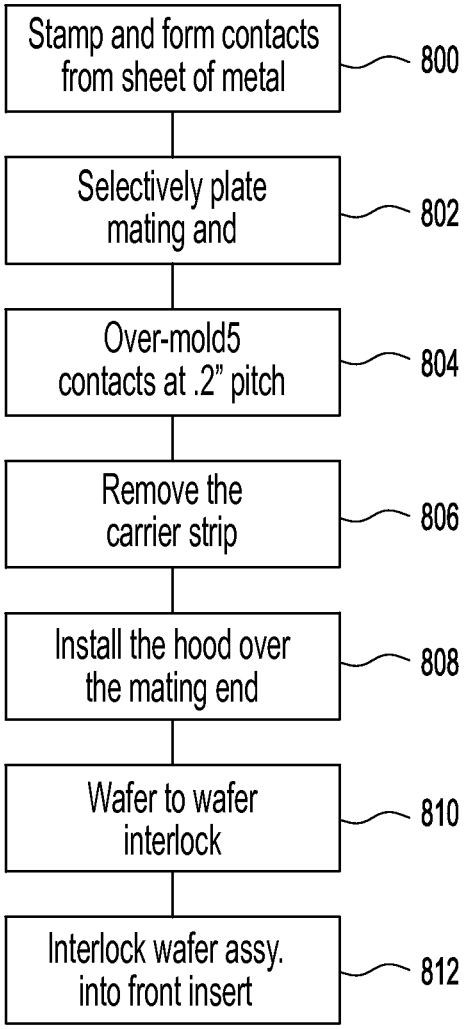
FIG. 6 is a flow chart showing the steps of assembling the connector illustrated in FIG. 4.

FIG. 6 illustrates the method of manufacturing the connector 100. The method includes forming first and second contact wafers by first forming the contacts 210 by stamping a metal sheet at step 800. The mating ends 212 of the contacts 210 may optionally be selectively plated, such as by gold plating, at step 802. Next, the overmold 220 is applied to a group of the contacts 210 for each contact wafer at step 804. In a preferred embodiment, the overmold 220 is applied to five contacts at a 0.200 inch pitch. The carrier strip 211 is then removed from the contacts 210 of each wafer at step 806 and the mating hoods 215 are installed on the mating ends 212 of the contacts 210 at step 808. The wafers are then interlocked with one another at step 810 such that the recessed surfaces 230 of each wafer accepts a corresponding portion of the other wafer, thereby forming the wafer assembly 120. The wafers preferably fit together in a slight press-fit. The wafer assembly 120 can then be installed into the housing 110 from the printed circuit board side 402 of the housing at step 812. The wafer assembly 120 is installed such that each contact 210 is received in a respective cavity 404 until the stopping shoulders 234 of the overmold 220 abuts the installation end 408 of each cavity 404, as seen in FIG. 5. The stopping tab 232 of the overmold 220 also abuts the overhang 420 of the housing 110 to prevent the wafer assembly 120 from being inserted too far into the housing 110. Once installed in the housing 110, the contact mating ends 212 are exposed at one side and ready to engage a mating component and the contact tail ends 214 are exposed at the other side and ready to engage a printed circuit board. A plurality of wafer assemblies 120 can be similarly installed in the housing 110 to form the connector 110, as seen in FIG. 1.

Figure 7:
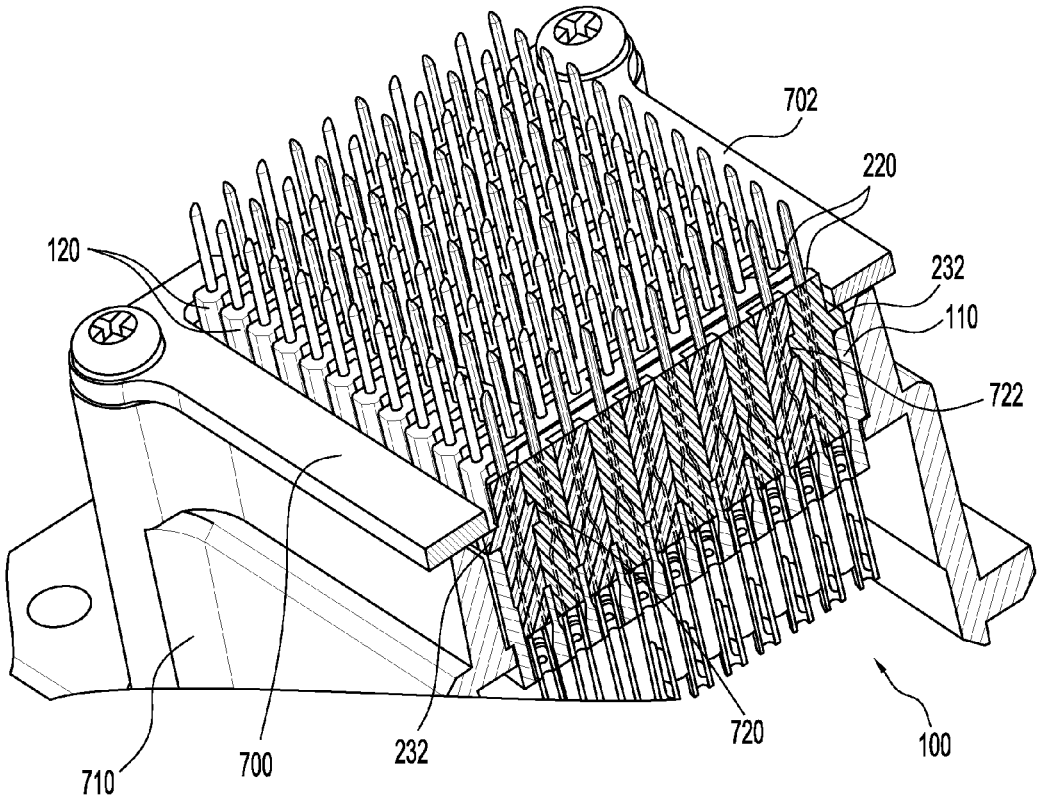
FIG. 7 is a perspective view an alternative embodiment of the connector illustrated in FIG. 1, showing retention plates added to the connector.

FIG. 7 illustrates an alternative embodiment of the present invention that includes one or more retention plates 700 and 702 provided at the printed circuit board side 402 of the housing 110 to secure the wafer assemblies 120 in the housing 110. The retention plates 700 and 702 are configured to cover the stopping tabs 232 of the wafer assemblies to prevent the wafer assemblies 120 from backing out of the housing 110. The retention plates 700 and 702 are preferably attached to a support 710 of the connector 100 by any known manner, such as screw fasteners 712.

As seen in FIG. 7, the overmold 220 of the wafers 200 of each of the wafer assemblies 120 may optionally include an inwardly extending locking tab 720 that engages a corresponding channel 722 of the adjacent interlocked wafer that forms the wafer assembly. The locking tab 720 and channel 722 provide an additional mechanism for securing the two wafers 200 together that form the water assembly.

Although certain presently preferred embodiments of the disclosed invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A contact wafer, comprising:

a plurality of contacts, each of said contacts having a body portion with a mating end and an opposite tail end, said mating end being configured to couple to a mating contact and said tail end being configured to engage a printed circuit board; and an overmold surrounding said body portions of said plurality of contacts such that said mating ends and said tails ends of said contacts are exposed and extend from opposite first and second ends of said overmold, said overmold having a first side including a plurality of recessed surfaces, each recessed surface being between adjacent body portions of said plurality of contacts and sized to receive a corresponding portion of an overmold of another contact wafer, and said overmold having a stopping member extending from a third end that extends between said first and second ends, said stopping member extending in a direction substantially perpendicular to a length of said plurality of recessed surfaces.

2. A contact wafer according to claim 1, wherein said overmold is a unitary one-piece member.

3. A contact wafer according to claim 1, wherein said overmold has a second side opposite said first side, said second side is substantially flat.

4. A contact wafer according to claim 1, wherein said overmold includes an inwardly extending locking tab.

5. A contact wafer according to claim 1, wherein said tail end is a solder or press fit end.

6. A contact wafer according to claim 1, wherein each of said mating ends includes a mating hood.

7. A connector, comprising:

a housing having a mating interface side and a printed circuit board engagement side opposite said mating interface side, and at least one cavity extending between said mating interface and printed circuit board engagement sides;

at least one contact received in said at least one cavity, said contact including a body portion with a mating end for coupling to a mating contact and a tail end opposite said mating end for engaging a printed circuit board; and an overmold covering said body portion of said contact such that said mating and tail ends extend from opposite first and second sides of said overmold and said mating end is exposed at said mating interface side of said housing and said tail end is exposed at said printed circuit board engagement side of said housing, and said overmold having a stopping member adapted to abut said housing, said stopping member extending from a third end of said overmold that extends between said first and second ends, said stopping member extending in a direction substantially perpendicular to a length of said plurality of recessed surfaces.

8. A connector according to claim 7, wherein said housing includes an overhang extending substantially along a perimeter of said housing at said printed circuit board engagement side.

9. A connector according to claim 7, wherein said housing is a unitary one-piece member.

10. A connector according to claim 7, wherein said tail end is a solder or press fit end.

11. A connector, comprising:

a housing having a mating interface side and a printed circuit board engagement side opposite said mating interface side, a plurality of cavities extending between said mating interface and printed circuit board engagement sides; and a wafer assembly coupled to said housing, said wafer assembly including first and second contact wafers, each of said first and second contact wafers including, a plurality of contacts adapted to be received in said cavities of said housing, each of said contacts having a body portion with a mating end and an opposite tail end, said mating end being configured to couple to a mating contact and said tail end being configured to engage a printed circuit board, and an overmold surrounding said body portions of said plurality of contacts such that said mating ends and said tails ends of said contacts extend from opposite ends of said overmold and said mating ends are exposed at said mating interface side of said housing and said tail ends are exposed at said printed circuit board engagement side of said housing, wherein said first and second contact wafers are interlocked with one another such that said contacts of said first contact wafer alternate with said contacts of said second contact wafer, and wherein said mating ends of said first and second contact wafers are aligned, and said tail ends of said first and second contact wafers are aligned.

12. A connector according to claim 11, wherein each of said first and second contact wafers includes a first side that has a plurality of recessed surfaces between adjacent body portions of said plurality of contacts that are sized to receive a corresponding portion of an overmold of another contact wafer.

13. A connector according to claim 11, wherein said overmold is a unitary one-piece member.

14. A connector according to claim 11, wherein said first and second contact wafers are identical.

15. A connector according to claim 11, wherein said housing includes an overhang extending substantially along a perimeter of said housing at said printed circuit board engagement side.

16. A connector according to claim 11, wherein said overmold has opposite ends, and said overmold includes a stopping member that extends from one of said ends.

17. A connector according to claim 11, wherein said cavities are arranged in rows and columns.

18. A connector according to claim 11, wherein said housing includes at least one retention plate at said printed circuit board engagement side, said at least one retention plate covering a portion of said overmold of each of said first and second contact wafers.

19. A connector according to claim 11, wherein said housing is a unitary one-piece member.

20. A method of manufacturing of a connector, comprising the steps of:

forming a first contact wafer by providing a first group of contacts, each contact including a body portion, a mating end, and a tail end, and applying an overmold to the body portions;

forming a second contact wafer by providing a second group of contacts, each contact including a body portion, a mating end, and a tail end, and applying an overmold to the body portions of the of contacts;

interlocking the first and second contacts to form a wafer assembly such that the mating ends of the first and second contact wafers are aligned and the tail ends of the first and second contact wafers align; and installing the wafer assembly into a printed circuit board engagement side of a connector housing such that the mating ends of the first and second contact wafers are exposed at a mating interface side of the connector housing.

21. A method according to claim 20, further comprising the step of stamping the contacts of the first and second group of contacts.

22. A method according to claim 21, further comprising the step of removing a carrier strip after applying the overmold to the body portions of the contacts.

23. A method according to claim 22, further comprising the step of applying a mating hood to each of the mating ends of each of the contacts.

24. A method according to claim 23, further comprising the step of securing at least one retention plate to the printed circuit board engagement side of the connector housing.

25. A method according to claim 23, further comprising the step of installing a plurality of wafer assemblies into the printed circuit board engagement side of the connector housing.

26. A connector, comprising:

a housing having a mating interface side and a printed circuit board engagement side opposite said mating interface side, a plurality of cavities extending between said mating interface and printed circuit board engagement sides; and a wafer assembly coupled to said housing, said wafer assembly including first and second contact wafers, each of said first and second contact wafers including, a plurality of contacts adapted to be received in said cavities of said housing, each of said contacts having a body portion with a mating end and an opposite tail end, said mating end being configured to couple to a mating contact and said tail end being configured to engage a printed circuit board, and an overmold surrounding said body portions of said plurality of contacts such that said mating ends and said tails ends of said contacts extend from opposite ends of said overmold and said mating ends are exposed at said mating interface side of said housing and said tail ends are exposed at said printed circuit board engagement side of said housing, wherein said first and second contact wafers are interlocked with one another such that said contacts of said first contact wafer alternate with said contacts of said second contact wafer, wherein said housing includes at least one retention plate at said printed circuit board engagement side, and said at least one retention plate covering a portion of said overmold of each of said first and second contact wafers.

* * * * *